United States Patent [19]

Walser

[11] Patent Number: 4,826,704

[45] Date of Patent: May 2, 1989

[54] PROCESS OF COATING A BODY AND APPARATUS THEREFOR

[75] Inventor: Felix Walser, Hinwil, Switzerland

[73] Assignee: Prazisions-Werkzeuge AG, Ruti, Switzerland

[21] Appl. No.: 49,815

[22] Filed: Apr. 30, 1987

Related U.S. Application Data

[63] Continuation of Ser. No. 754,911, Jul. 15, 1985, abandoned.

[30] Foreign Application Priority Data

Jul. 13, 1984 [CH] Switzerland ..... 3421/84

[51] Int. Cl.[4] ..... B05D 1/06

[52] U.S. Cl. ..... 427/28; 427/27; 427/421; 118/629; 118/634; 118/317; 118/323; 118/326

[58] Field of Search ..... 427/27, 28, 421; 118/629, 634, 317, 323, 326

[56] References Cited

U.S. PATENT DOCUMENTS 3,868,925 7/1973 Smith ..... 427/191
4,215,648 8/1980 Stamets ..... 427/286

FOREIGN PATENT DOCUMENTS 0093083 of 1983 European Pat. Off. .

*Primary Examiner*—Richard Bueker
*Attorney, Agent, or Firm*—Antonelli, Terry & Wands

[57] ABSTRACT

In order to increase the efficiency of a coating process wherein a coating medium such as, for example, powders directed from a coating medium pressure line toward a workpiece to be coated, with the coating process also including an applied electrostatic field, a coating medium which does not adhere to the workpiece is drawn off by way of a suction channel. A flow of the emerging coating medium is bent toward the workpiece that is to be coated by providing a carrier surface profile area between an outlet of the coating medium and a suction channel. By this arrangement a flow velocity gradient between the workpiece to be coated and the profile area is realized with the resulting pressure gradient from the profiled area toward the workpiece.

27 Claims, 1 Drawing Sheet

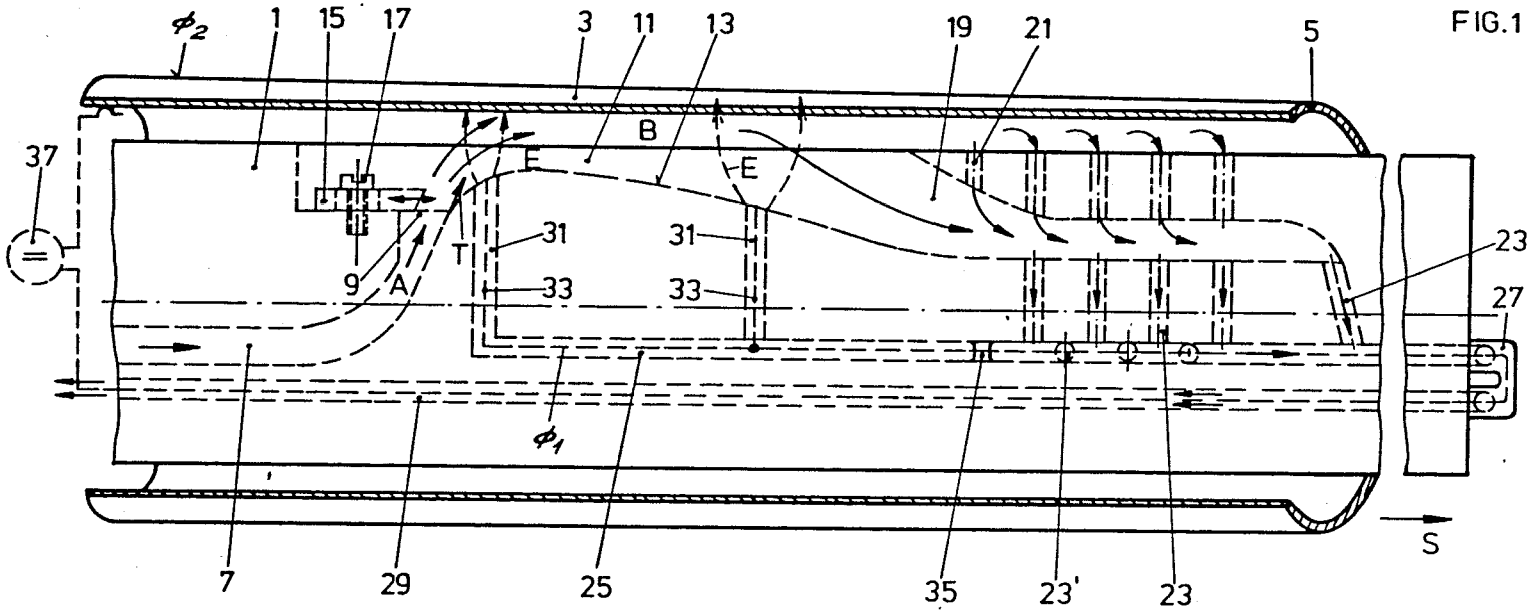
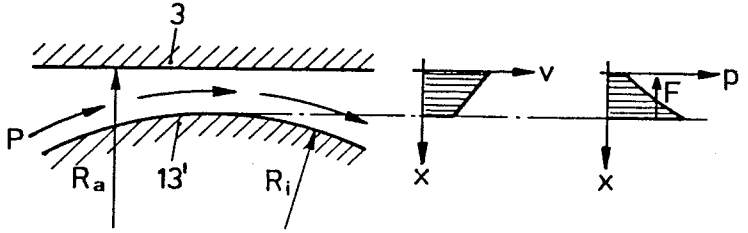
FIG.2

PROCESS OF COATING A BODY AND APPARATUS THEREFOR

This is a continuation of application Ser. No. 754,911, filed July 15, 1985 now abandoned.

The present invention relates to a coating process and apparatus wherein a coating medium, such as a powder, under pressure, is supplied through a coating medium feed line and emerges at least through one outlet opening in the form of a spray jet, with the process and apparatus being adapted to coat an interior of hollow bodies such as, for example, metal cans, perferably, in a flow-through serial operation along a welding seam of the hollow bodies.

Coating processes such as powder coating processes have been proposed wherein a coating medium, in the form of a powder, is carried along by compressed air, and is sprayed from an outlet opening directed in a direction of a part of the body to be coated. In these proposed processes, the amount of spray coating medium applied to the part of the body to be coated depends upon, among other things, the direction and size of the forces acting on the coating medium after leaving or exiting the outlet opening.

The greater the energy gradient for the coating medium between the exit opening and the part of the body to be coated, the greater the portion of coating medium which strikes the body to be coated. For this purpose, the production of an electrostatic high field has been proposed in an outlet opening area and the body to be coated, as a result of which, upon emergence, charged coating medium particles or droplets are electrically driven against the bodies to be coated.

The aim underlying the present invention essentially resides in enlarging a field of force between the outlet opening area and the body to be coated.

For this purpose, in accordance with the present invention, the flow of coating medium in an area of coating is preferably continuously curved in a direction towards the body to be coated.

By virtue of the present invention, it is possible to take advantage of the fact that, in the case of a turn around of a flow of coating medium conditional on gradients of the velocity of flow, there develops lesser speed along the inside arch, greater speed along the outside arch, and, on the basis of continuity conditions, a pressure gradient directed away from the inside arch toward the outside arch and, thus, a field of forces directed in the same direction. Although the arching or curving of the outflowing medium may be determined by suitable arrangements determining the inside radius or outside radius and provided especially for this purpose, it is proposed, in accordance with the present invention, that, for the sake of simplicity, that flow coating is driven between the body determining the outside radius of the curvature and a part determining the inside radius of curvature. It must be made sure that the radius of curvature of the part determining the inside radius is less than the radius of curvature of the body to be coated in the coating area which, for example, may take the form of a body extending straight or axially in direction of flow, that is to say, in a corresponding cut, since the straight line must indeed be considered as a border value (limes-value) of an increasing radius of curvature. In order to achieve a controlled flow in the coating area between the above described curvature, in accordance with the present invention, the stream of coating medium is produced at the same time by application of vacuum pressure at the end-terminal side of the curved path along which the medium flows.

To further enhance the effects of the present invention, it is posible to also include an electrostatic method for producing an additional field of force by supplying an electrostatic field in an area of the body to be coated.

In accordance with additional advantageous features of the coating arrangement of the present invention, an area of the outlet opening for the coating medium has a convex configuration.

To prevent the development of turbulence and to prevent the formation of cavities which lend themselves to the deposit of coating medium, according to the present invention, the shaping or profile is continuous and is preferably wing-profile-shaped, with a thickest portion of the wing-shape being located towards the area of the discharge opening.

Additionally, to prevent or minimize a development of turbulences at the exit or discharge area of the coating medium under pressure, an axis of the outlet opening is at least substantially parallel to a tangent of the profiled surface in an area of the discharge or outlet opening.

To create the possibility of optimum conditions, in accordance with further features of the present invention, the outlet opening comprises an adjustment arrangement for enabling an adjustment of a direction of the main stream-jet. direction with regard to a tangent of the profiled surface in the area of the outlet opening.

To enable the establishment of an electric field force, in accordance with the present invention, an electrode arrangement is provided in the area of the coating of the body for producing an electrostatic potential.

According to the present invention, one electrostatic potential is fixed at the electrode arrangement and, on the other side, towards the body to be coated, a second potential is fixed by the body itself or a further electrode arrangement, which, together with the first potential, produces the field producing difference of the two potentials. For the control of the flow of the coating medium in the coating area as well as for the purpose of drawing off portions of the coating medium of a powder or fluid medium which do not adhere to the body being coated, a suction line arrangement is provided along a portion of the profiled area lying at a distance from the outlet opening.

Advantageously, in accordance with the present invention, a profiled area on the side facing away from the outlet opening preferably continuously extends in a suction channel with which turbulences will be largely avoided in the coating medium, which turbulences could detach the coating medium deposited on the body being coated.

In order to allow dropping off parts of a coating medium from a body which is moved with respect to the coating arrangement, being drawn off even following the coating area, in accordance with the present invention, a suction channel communicates with suction bores guided to the outside.

With the provision of a pressure line for the coating medium and, possibly, a suction line, then, according to the present invention, a constructionally simple possibility presents itself enabling electrical contact by an electrode arrangement by virtue of the fact that an electric connection for the electrode arrangment may be disposed in or on an excess and/or vacuum pressure line for the coating medium thereby enabling the production of an integral unit.

Furthermore, in accordance with the present invention, to further constructionally simplify the entire arrangement, at least one bore is provided communicating with the line for the coating medium to the outlet opening or with the suction channel on a side of the profiled area lying at a distance from the outlet opening, which bore emerges or exits in an area of the profiled area. A wire shaped, preferably coaxially mounted electrode, is guided at least and preferably up to the outlet, whereby the bore to the line of the coating medium or toward the suction channel is closed in a medium-tight manner.

The increase in the flexibility of use of a coating arrangement such as proposed by the present invention is due to the fact that the coating arrangement is developed as a unilateraly fed coating medium and, optionally, electrical feeding, extension arm accommodating the components of the coating arrangement.

The proposd coating process and coating arrangement of the present invention are excellently suited for the coating of hollow bodies such as the inside flow-through coating of metal can bodies, as well as coating of a welding seam of the metal can bodies and also enables the use of a coating powder These and other objects, features, and advantages of the present invention will become more apparent from the following description when taken in connection with the accompanying drawings which show, for the purpose of illustration only, one embodiment in accordance with the present invention.

FIG. 1 is a partially schematic cross-sectional view of a coating arrangement according to the present invention, with a can body to be coated arranged therein;

FIG. 2*a* is a schematic partial cross-sectional view of an area of coating of the coating arrangement of FIG. 1;

FIG. 2*b* is a graphical illustration of a qualitative profile of the flow velocity of the medium in a coating area of the coating arrangement of FIG. 1; and FIG. 2*c* is a graphical illustration of a pressure distribution and action of forces resulting therefrom in the coating area of the coating arrangement of FIG. 1.

Referring now to the drawings wherein like reference numerals are used throughout the various views to designate like parts and, more particularly, to FIG. 1, according to this figure, a coating arrangement according to the present invention includes a carrier shaped body in the form of, for example, a cylindrical-shaped arm 1. For an interior coating of hollow bodies such as, for example, bodies of metal cans 3, along, for example, a welding seam area 5, the cylindrical-shaped arm 1 is unilaterally mounted to the left in FIG. 1 and is supplied or fed from this side in a manner to be described more fully hereinbelow. A coating medium pressure line 7 for transporting for example, powder particles by compressed air, first extends axially through the cylindrical-shaped arm 1 and is then radially bent back so as to lead or extend to an outlet opening 9 and into a coating chamber in the form of an axially extending channel 11 formed or worked into the cylindrically-shaped arm 1. In the outlet area, a base surface of the channel 11 includes a constantly convexly arched profiled or guiding surface area 13 in the form of an upper profile of a wing. The coating medium pressure line 7 is guided in its outlet area so that a main axis A of the outlet area lies at least substantially parallel to a tangent T on the convexly arched area 13 of the wing profile.

An adjustable slide 15 which may be readily exchangeable, is disposed on a cylindrically-shaped arm 1 and fixed thereto by fastener means such as, for example, a screw 17, thereby enabling an adjustment with respect to a direction and effective flow along the main axis A of the coating medium from the outlet opening 9. The outlet opening 9 for the coating medium, being under pressure and lying in an opposite direction, introduces the carrier surface profiled area 13 continuously into a suction of exit channel 19 which is formed in the cylindrically-shaped arm 1.

A channel 19 communicates by way of, for example, radially outwardly extending suction bores 21 with the surface of the cylindrically-shaped arm extending in a direction of the coating area B and is further connected by a plurality of bores 23 with a suction line 25 which is disposed in parallel to a longitudinal center axis of the cylindrically-shaped arm 1. At the free end of the arm 1, lying to the right of FIG. 2, the suction line 25 discharges and is connected by, for example, a U-shaped or arched hose 27, with a vacuum pressure feed line 29 extending substantially axially through the arm 1. Suction bores 23', projecting laterally on both sides communicate with the line 25. The line 25 is guided toward the supported end of the arm 1 and against an area of the outlet opening 9 and includes bores 31 projecting radially outwardly, with the bores 31 emptying or discharging in the area of the profiled surface 13. Wire shaped electrodes 33 to which an electrostatic potential $\phi_1$ is applied are coaxially fixed in bores 31 for applying an electrostatic field between the cylindrically-shaped arm 1 and the body 3 to be sprayed which latter being laid on an electrostatic potential $\phi_2$, and an electric connection 35 for the electrodes 33 extends as a coaxial line through the line 25, the hose 27, and the line 29 to the feed side of the arm 1. A seal 35', between the suction area and the profile area 13 seals the bores 31 and electrodes 33 against the vacuum pressure prevailing in the lines 29, 25.

The coating medium under pressure emerges from the outlet opening 9 and is driven against the area of the body 3 as a result of the action of the electrostatic field E between the body 3 and electrodes 33 produced by a high voltage D.C. source 37 which generates a voltage according to the potential difference $\phi_2-\phi_1$. Additionally, as apparent from FIG. 2*a*, the stream of coating medium is forced to flow along a curved path P between the body 3 and profiled area 13', preferably developed as a carrier wing-upper profile as profile 13 of FIG. 1. At the same time, the qualitative velocity profile v across the medium-path of FIG. 2*a* and illustrated in FIG. 2*b*, develops as a result of a smaller inside radius $R_i$ as compared to the larger outside radius $R_a$ which is endless in the case of a straight body 3 in the direction. Because of the higher flow velocity v of the medium at the body 3 than at the profiled area 13', a vacuum pressure develops towards the body 3 with a field force F directed as shown most clearly in FIG. 2*c* towards the body 3. In this manner, the coating medium, possibly in supplementation of the electrostatic field force, is driven in a direction of the body 3. Stated another way, the space between the body 3 and the profiled area or guiding surface 13' as shown in FIG. 2*a* continuously narrows and then widens so as to first compress the stream of coating medium toward the surface of the body 3 as the stream propagates through the coating chamber, and then expand the stream in a direction away from the surface of the body as the jet further propagates in the coating chamber. Coating material which does not adhere to the body 3 such as powder or droplets will be drawn off at the suction channel 19 and through the bores 23 and, subsequently, the coating material dropping off the body 3 will be drawn through the bores 21 and 23' communicating with the suction channel 19.

The electric connection for the electrodes 33 may also be accomplished through the pressure line 7 in an analoguous manner whereby the bores 31 are closed against the pressure line with a seal similar to the seal 35'. Preferably there is then no seal, to have the electrode's flushed by the pressurised air in line 7.

With the arrangement described hereinabove and the process realized thereby, a considerable increase of the quantity of deposit per time unit of the coating medium on the body 3 to be coated will be achieved, which is essential especially in the case of quick throughflow processes, that is to say, whenever the body 3 according to FIG. 1 is moved through quickly in a direction designated by the arrow S. As powder coating medium polyester- or epoxy-based powder may be used as VP91, VP99 etc. of the Fa. Vernicolor.

While I have shown and described only one embodiment in accordance with the present invention, it is understood that the same is not limited thereto but is susceptible of numerous changes and modifications as known to one having ordinary skill in the art, and I do not wish to be limited to the details shown and described here, but intend to cover all such modifications as are encompassed by the scope of the appended claims.

I claim:

1. A process for coating a first surface of a body, the process comprising the steps of ejecting a jet of a coating medium from a nozzle arrangement towards the first surface of the body, removing a part of said ejected jet by suctioning with a suctioning means after said ejecting and, after said ejecting, guiding said jet on one side of said jet of coating medium towards and along a part of the first surface of the body towards said suctioning means and on an opposite side of said jet, guiding said jet along a second surface spaced from and opposite said first surface towards said suctioning, said second surface having shape that is steadily bent from adjacent said nozzle arrangement towards said first surface of the body and wherein a radius of curvature defined by the first surface for guiding said jet at said one side thereof is greater than the radius of curvature of said steadily bent shape said opposite second surface to steadily lead said jet towards said first surface and from said nozzle arrangement towards said suctioning means, thereby substantially preventing deposition of said coating medium of said jet on said second surface.

2. A process for coating a first surface of a body according to claim 1, further comprising the step of adjusting the direction in which the coating medium is ejected towads the first surface.

3. A process for coating a first surface of a body according to claim 1, further comprising the step of adjusting the effective flow of the coating medium ejected towards said first surface.

4. A process for coating a first surface of a body according to claim 1, wherein said coating medium is removed by suctioning through a removing opening which has an axis which is at least substantially parallel to a tangent of said second surface in an area of the removing opening to thereby prevent or minimize development of turbulence at the removing opening during said step of removing a part of the coating medium.

5. A process for coating a first surface of a body according to claim 1, wherein said second surface is convexly bent in the direction of said first surface of the body to thereby compress said ejected jet toward said first surface of the body as said jet propagates along said second surface towards said first surface and to expand said compressed jet as said jet propagates along said second surface in a direction away from said first surface of the body.

6. A process for coating a first surface of a body according to claim 1, wherein said second surface is steadily bent such that it has a constantly increasing radius of curvature in a direction of propagation of said jet along said second surface.

7. A coating arrangement for coating a surface of a body, the coating arrangement comprising a feed line means for supplying a coating medium under pressure through at least one spray opening for directing a coating medium towards the surface of the body, a suctioning line means for removing a part of said coating medium through at least one removing opening, means defining a steadily bent surface between said at least one spray opening and said at least one removing opening and in spaced opposed relationship to said surface of the body to be coated, said steadily bent surface being bent from adjacent said spray opening towards said surface of the body to be coated for interacting with said coating medium after it has been ejected from said at least one spray opening and before a part of said coating medium is removed through said at least one removing. opening and as said coating medium moves from said at least one spray opening towards said at least one removing opening between said opposed surfaces, to lead at least a part of said coating medium steadily towards said surface of the body to be coated, the radius of curvature of said steadily bent surface being smaller than a radius of curvature of said surface of the body to be coated.

8. A coating arrangement according to claim 7, wherein said steadily bent surface has a convex shape with the thickest portion thereof lying in an area of said injection opening.

9. A coating arrangement according to claim 7, wherein a center axis of the at least one spray opening extends substantially parallel to a tangent of said steadily bent surface in an area of said at least one spray opening.

10. A coating arrangement according to claim 9, further comprising means for adjusting the direction of a jet of coating medium injected from the at least one spray opening, with respect to the tangent in the area of the at least one spray opening.

11. A coating arrangement according to claim 7, further comprising means for generating an electrostatic field including an electrode means disposed in an area of the at least one spray opening for producing an electric potential on the coating medium.

12. A coating arrangement according to claim 11, wherein said at least one removing opening is provided on a shaped portion of said steadily bent surface lying away from the at least one spray opening.

13. A coating arrangement according to claim 12, wherein the suctioning line means includes a suction channel, and wherein a continuously shaped profile of said at least one steadily bent surface leads through the removing opening and into the suction channel on a side thereof away from the at least one spray opening.

14. A coating arrangement according to claim 13, wherein a plurality of suction bores are provided and extend in a radially outward direction, said suction channel communicating with the suction bores.

15. A coating arrangement according to claim 14, wherein at least one electric connection means is provided for the electrode means, said electric connection means being integrated into at least one of the feed line means for supplying the coating medium under pressure through said at least one spray opening, and the suctioning line means.

16. A coating arrangement according to claim 14, wherein at least one bore means is provided in said steadily bent surface in the area of at said at least one spray opening and the removing opening, said bore means being connected to said suctioning line means, said at least one bore means having an electrode of the electrode means which is coaxially disposed in each of said bore means, and wherein means are provided for sealing the bore means with respect to the suctioning line means.

17. A coating arrangement according to claim 16, wherein said coating arrangement is accommodated in a unilaterally fed extension arm.

18. A coating arrangement according to claim 7, wherein said body to be coated is a metal can and wherein said coating is effected in a serial operation along an inner surface of a welding seam of the metal can.

19. A coating arrangement according to claim 7, wherein said coating medium is in the form of a powder coating.

20. A coating arrangement according to claim 7, further comprising means for adjusting the direction in which the coating medium is directed towards the surface of the body from the at least one spray opening.

21. A coating arrangement according to claim 20, wherein said means for adjusting includes a slide which is adjustably positioned for adjusting the direction in which the coating medium is directed from the at least one spray opening toward the surface of said body.

22. A coating arrangement according to claim 7, further comprising means for adjusting the effective flow of the coating medium directed toward the surface of the body from the at least one spray opening.

23. A coating arrangement according to claim 22, wherein said means for adjusting includes a slide which is adjustably positioned for adjusting the effective flow of coating medium directed toward the surface of the body from the at least one spray opening.

24. A coating arrangement according to claim 7, wherein said removing opening has an axis which is at least substantially parallel to a tangent of the steadily bent surface in an area of the at least one removing opening to thereby prevent or minimize development of turbulence at the at least one removing opening.

25. A coating arrangement according to claim 7, wherein said at least one steadily bent surface is convexly bent in the direction of said surface of the body to be coated.

26. A coating arrangement according to claim 7, wherein said at least one steadily bent surface has a constantly increasing radius of curvature in a direction from said at least one spray opening to said removing opening.

27. A coating arrangement according to claim 7, wherein the at least one steadily bent surface is configured as an upper profile of a wing.

* * * * *